US006319052B1

(12) United States Patent
Chang

(10) Patent No.: US 6,319,052 B1
(45) Date of Patent: Nov. 20, 2001

(54) FLEXIBLE PRINTED CIRCUIT CONNECTOR

(75) Inventor: Jen Jou Chang, Yung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/748,878

(22) Filed: Dec. 26, 2000

(30) Foreign Application Priority Data

Nov. 10, 2000 (TW) ..... 89219488

(51) Int. Cl.[7] ..... H01R 12/24; H01R 13/62

(52) U.S. Cl. ..... 439/495; 439/260

(58) Field of Search ..... 439/329, 495, 439/260, 492, 493, 494, 67, 77, 108, 570, 566

(56) References Cited

U.S. PATENT DOCUMENTS 6,015,310 * 1/2000 Tojo ..... 439/260

6,089,904 * 7/2000 Wu ..... 439/495

* cited by examiner

*Primary Examiner*—Tulsidas Patel
*Assistant Examiner*—Chandrika Prasad
(74) *Attorney, Agent, or Firm*—Wei Te Chung

(57) ABSTRACT

A flexible printed circuit connector (1) includes a substantially rectangular housing (10), a plurality of terminals (20) received in the housing, an actuator (40) preliminarily mounted on the housing and a pair of solder pads (30). The housing has a rear wall (106) and a pair of sidewalls (103) opposite to each other. Each sidewall forms a pair of bosses (109, 110) on the sidewall and defines a cutout (111) between the bosses. The actuator has a pair of locking arms (406). Each locking arm has an upper protrusion (410) formed on a top face thereof for retaining the actuator to the housing at an initial position, and a lateral protrusion (409) projecting from an inner side of a distal end thereof for engaging in a corresponding cutout of the housing at the initial position.

8 Claims, 4 Drawing Sheets

FLEXIBLE PRINTED CIRCUIT CONNECTOR

FIELD OF THE INVENTION

The present invention generally relates to an electrical connector and, more particularly, to a zero insertion force electrical connector for terminating a flexible printed circuit or the like.

BACKGROUND OF THE INVENTION

A wide variety of flexible printed circuit (FPC) connectors are presently used in different environments. These FPC connectors conventionally have a housing mounting a plurality of terminals in a generally parallel array spaced along an elongated hollow portion thereof for receiving an end of a flexible printed circuit (FPC). Typically, the connector uses an actuator to press the FPC against the terminals.

The actuator of the FPC connector typically is movable between a first temporary position allowing free insertion of the FPC into the elongated cavity in the housing, and a second position wherein a pressure plate of the actuator biases the FPC against the terminals. Furthermore, the first temporary position usually is unstable and insecure, and inconvenient for manually manipulating the FPC connector.

One of the ever-increasing problems with FPC connectors of the character described above involves manually manipulating the housing, the actuator and the FPC to terminate the FPC. Simply put, there are three components that must be manipulated, and the operator has only two hands. In other words, to carry out a termination operation, the operator must hold the connector with one hand and insert and hold the FPC with the other hand while using one or both of the hands to move the actuator while the FPC is still held in the hollow portion of the housing. Quite often, the FPC moves or shifts while the actuator is being moved, resulting in an inadequate or defective termination. It can be understood that this problem is magnified as the connectors become longer to accommodate more terminals.

Hence, an improved FPC connector is needed to overcome the above-mentioned deficiencies of current FPC connectors.

SUMMARY OF THE INVENTION

An object of the present invention is to provide an improved flexible printed circuit (FPC) connector which has an actuator preliminarily mounted on a housing for facilitating manipulation or insertion of a flexible printed circuit (FPC).

An FPC connector of the present invention comprises a substantially rectangular housing, a plurality of terminals received in the housing, an actuator and a pair of solder pads mounted on two sides of the housing for soldering the FPC connector to a circuit board.

The housing includes a front wall with a cavity exposed therein for receiving an end of the FPC, a top wall, a bottom wall, a rear wall and a pair of sidewalls opposite to each other. Each sidewall forms a first and a second bosses near the rear wall and defines a cutout between the first and second bosses.

The actuator comprises a main body with a pair of manual portions and a pair of locking arms formed at opposite sides of the main body for engaging the actuator with the housing. An elongated pressure plate extends rearward from the main body between the locking arms for biasing the FPC against the terminals. Each locking arm forms an upper protrusion on a top face thereof for securing the actuator to the housing at a first position, and a lateral protrusion at an inner side thereof for latching the first boss of the housing at the first position.

Each solder pad comprises a front part, a rear arm offset and spaced a distance apart from the front part, and a base connecting the front part with the rear arm for soldering to a circuit board.

When the FPC is inserted into the FPC connector, the actuator is at the first position. At the first position the actuator is preliminarily mounted on the housing with the upper protrusions being clamped by the front parts of the solder pads, and the lateral protrusions latching the first bosses of the housing. After the FPC is fully inserted into the FPC connector, the actuator is moved to a second position. In the second position, the actuator biases the FPC against the terminals while the front parts of the solder pad clamp the locking arms of the actuator, and the lateral protrusions of the actuator latch the rear wall of the housing. Thus, the FPC is secured.

Other objects, advantages and novel features of the invention will become more apparent from the following detailed description when taken in conjunction with the accompanying drawings.

DETAILED DESCRIPTION OF THE EMBODIMENT

Reference will now be made in greater detail to the preferred embodiment of the present invention.

Figure 1:
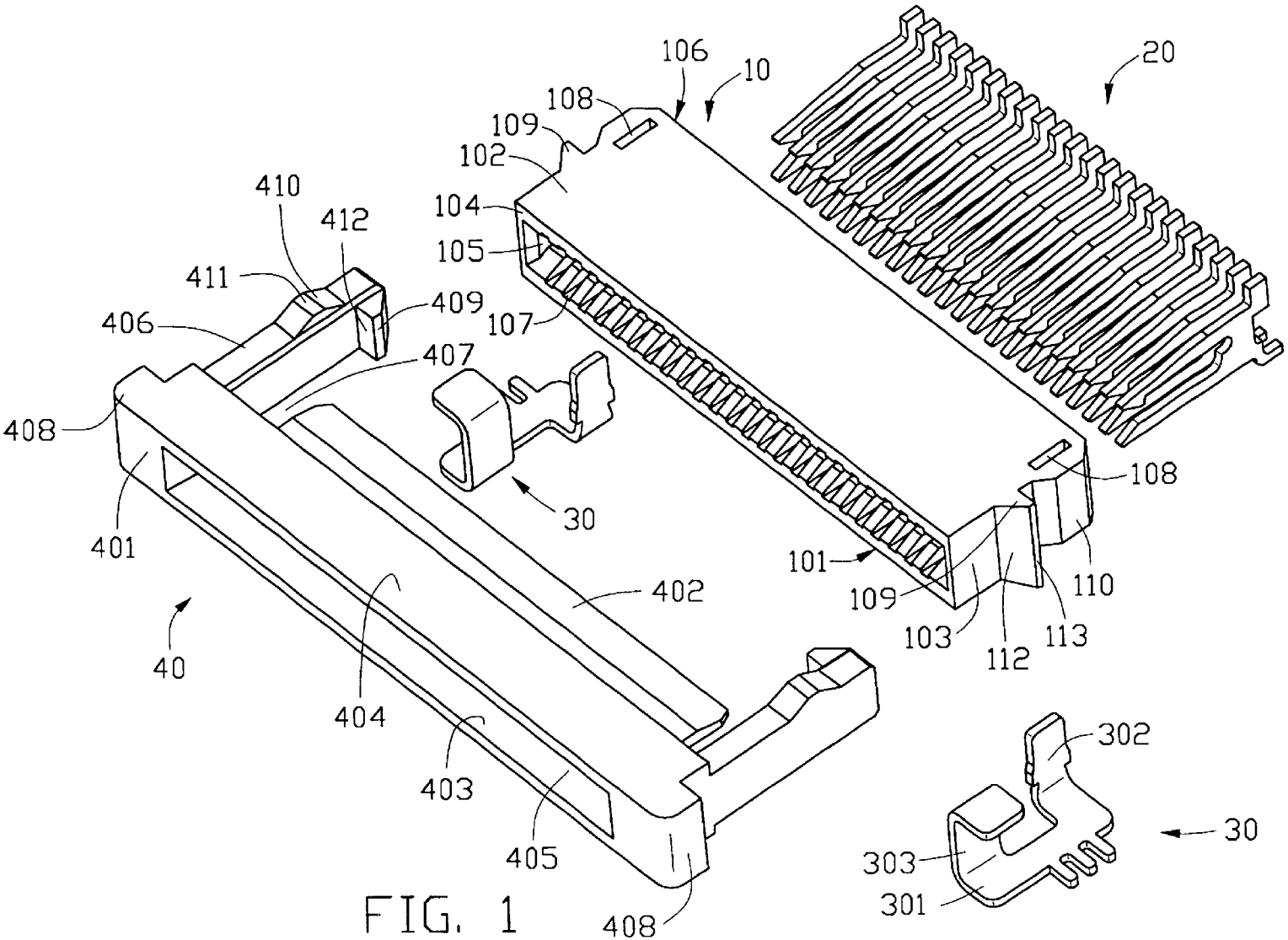
FIG. 1 is an exploded perspective view of a flexible printed circuit (FPC) connector in accordance with the present invention.
Figure 2:
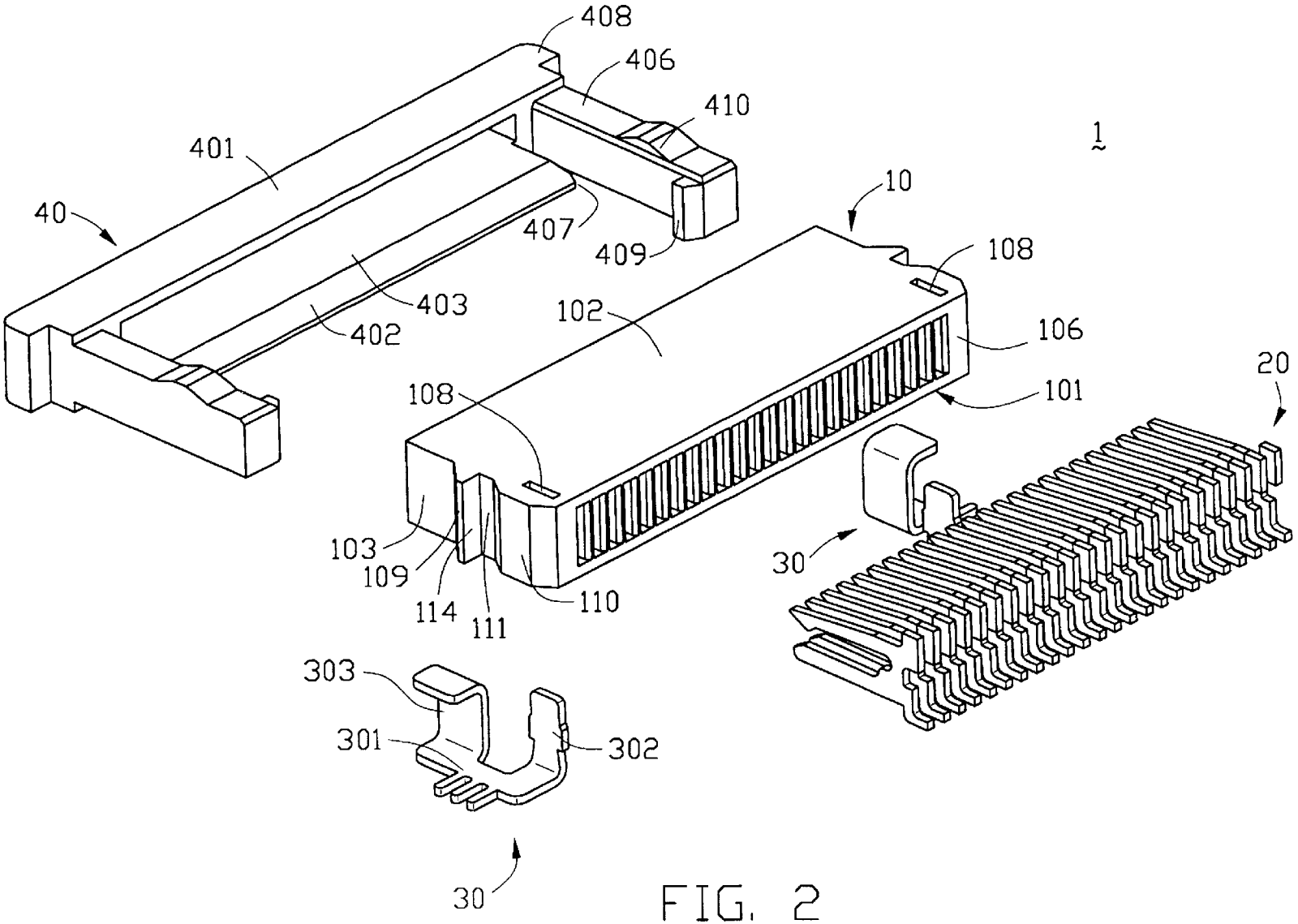
FIG. 2 is a view of the FPC connector of FIG. 1 from another perspective.

Referring to FIGS. 1–2, a flexible printed circuit (FPC) connector 1 in accordance with the present invention includes a substantially rectangular housing 10, a plurality of terminals 20, an actuator 40 and a pair of solder pads 30.

Figure 3:
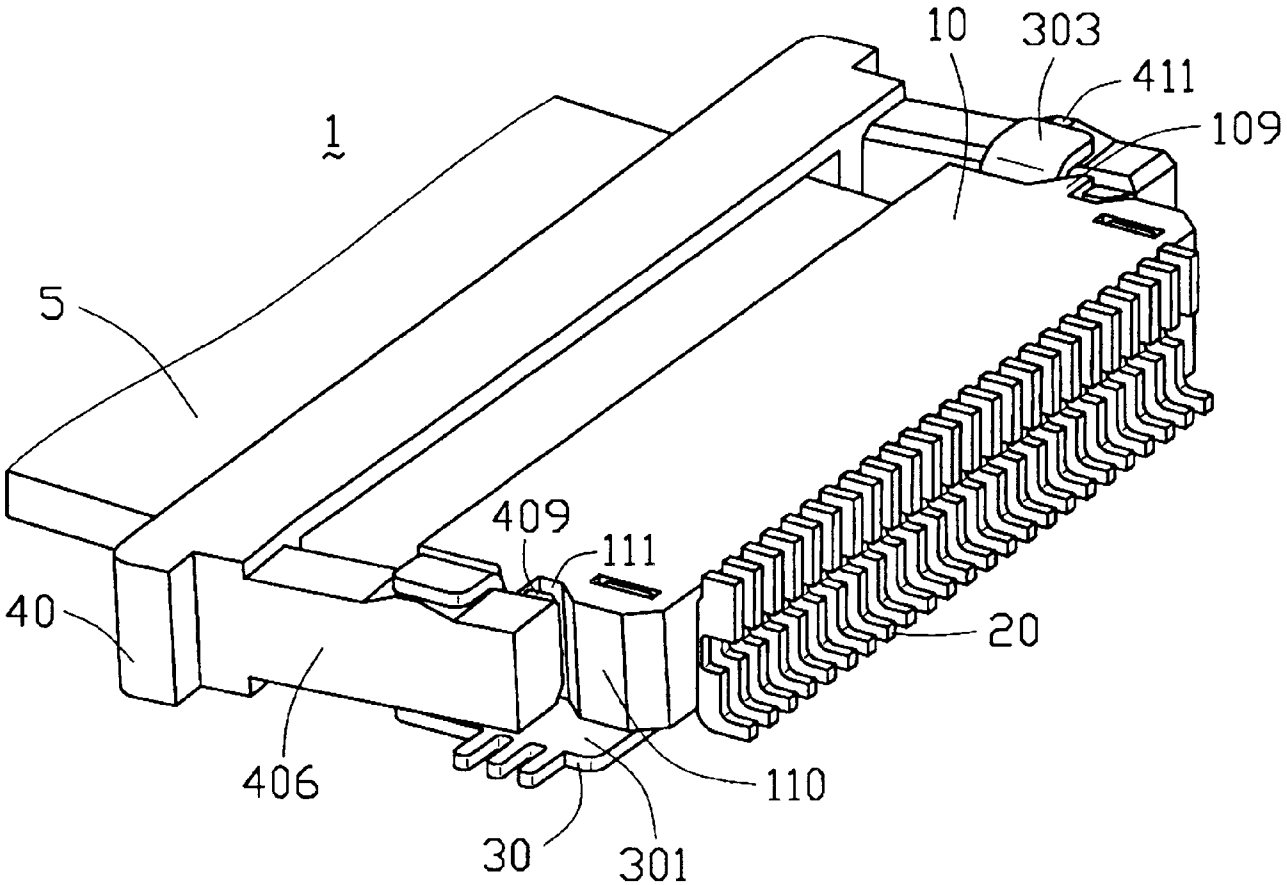
FIG. 3 is an assembled view of FIG. 2, wherein a flexible printed circuit is inserted into the FPC connector and an actuator of the FPC connector is at a first position.

The housing 10 includes an elongated bottom wall 101 and an elongated top wall 102 parallel to each other, a pair of sidewalls 103 opposite to each other, a rear wall 106 and a front wall 104. A cavity 105 is defined in the housing 10 through the front wall 104 for receiving an end of a flexible printed circuit (FPC) 5 therein (see. FIG. 3). A plurality of passageways 107 is defined in inner surfaces (not labeled) of the bottom and top walls 101, 102 and through the rear wall 106 which are in communication with the cavity 105 for receiving the terminals 20. A pair of slots 108 is defined through the top wall 102 and the bottom wall 101 and near the sidewalls 103. Each sidewall 103 forms a first boss 109 and a second boss 110, and defines a cutout 111 between the first and second bosses 109, 110. Each first boss 109 has a relatively narrow and generally planar outward first edge 113, with an inclined face 112 and a planar face 114 on opposite sides of the first edge 113. The planar face 114 is perpendicular to the sidewall 103. The second boss 110 is located rearward of the first boss 109, and has a geometry similar to that of the first boss 109 except that an outward second edge (not labeled) has a height lower than the first edge 113 of the first boss 109 and a rearward face (not labeled) is inclined rather than perpendicular to the sidewall 103.

The actuator 40 is unitarily formed and includes an elongated main body 401, and a pair of manual portions 408 on opposite sides of the main body 401. A locking arm 406 rearwardly extends from a rear face of each manual portion 408 for engaging the actuator 40 with the housing 10.

The main body 401 has a pressure plate 403 and a cover plate 404 opposite to each other, and defines an elongated hollow portion 405 between the pressure plate 403 and the cover plate 404 for receiving an end of the FPC 5. An elongated tongue 402 extends rearwardly from the elongated pressure plate 403, and is shaped with a decreasing thickness toward its rear for facilitating insertion into the cavity 105 of the housing 10. The locking arm 406 has a top face lower than a top face of the main body 401. A lateral protrusion 409 protrudes from a distal end of the locking arm 406 and has an engaging face 412 perpendicular to the locking arm 406. An upper protrusion 410 upwardly protrudes from a top face of each locking arm 406. Each upper protrusion 410 has a generally narrow and planar top face 411 and has a pair of inclined faces on front and rear sides of the top face 411. A pair of openings 407 is respectively defined between the pressure plate 403 and the locking arms 406 to permit entrance of the sidewalls 103 of the housing 10.

Each solder pad 30 includes a rear arm 302 for locking into a corresponding slot 108 for anchoring onto the housing 10, an outwardly facing U-shaped front part 303 for engaging with the locking arms 406 of the actuator 40, and a base 301 connecting the rear arm 302 with the front part 303 for soldering to a circuit board (not shown). Each front part 303 has a top arm (not labeled) parallel to the base 301 and defines a channel (not labeled) for not only guidably receiving the corresponding rib 404 therein but also providing intermediate restraint to the rib 404 when the rib 404 is locked at the first boss with regard to the housing. The rear arm 302 is offset and spaced a distance apart from the front part 303.

Referring to FIG. 3, before the FPC 5 is inserted into the FPC connector 1, the actuator 40 is preliminarily mounted in the housing 10 at a first position. To reach this position, the locking arms 406 of the actuator 40 slide rearwardly across the bases 301 of the solder pads 30. Each lateral protrusion 409 slides over a corresponding inclined face 112, the first edge 113 and the planar face 114 in sequence and is finally received in the cutout 111. The engaging face 412 of the lateral protrusion 409 abuts against the planar face 114 of the first boss 109. Thus, the lateral protrusion 409 latches against the first boss 109 of the housing 10 and thus the actuator 40 is prevented from disengaging from the housing 10. At the same time, the first edge 113 of the first boss 109 abuts an inner side of the locking arm 406, thereby providing an enlarged space between the actuator 40 and the housing 10 for facilitating insertion of the FPC 5 into the cavity 105 of the housing 10. A front end of the elongated tongue 402 of the actuator 40 is received in the housing 10. The front part 303 of the solder pad 30 reliably couples the actuator 40 to the housing 10 by restraining the top face 411 of the upper protrusion 410. At this first stable position, an end of the FPC 5 is freely inserted through the hollow portion 405 into the cavity 105 of the housing 10.

Figure 4:
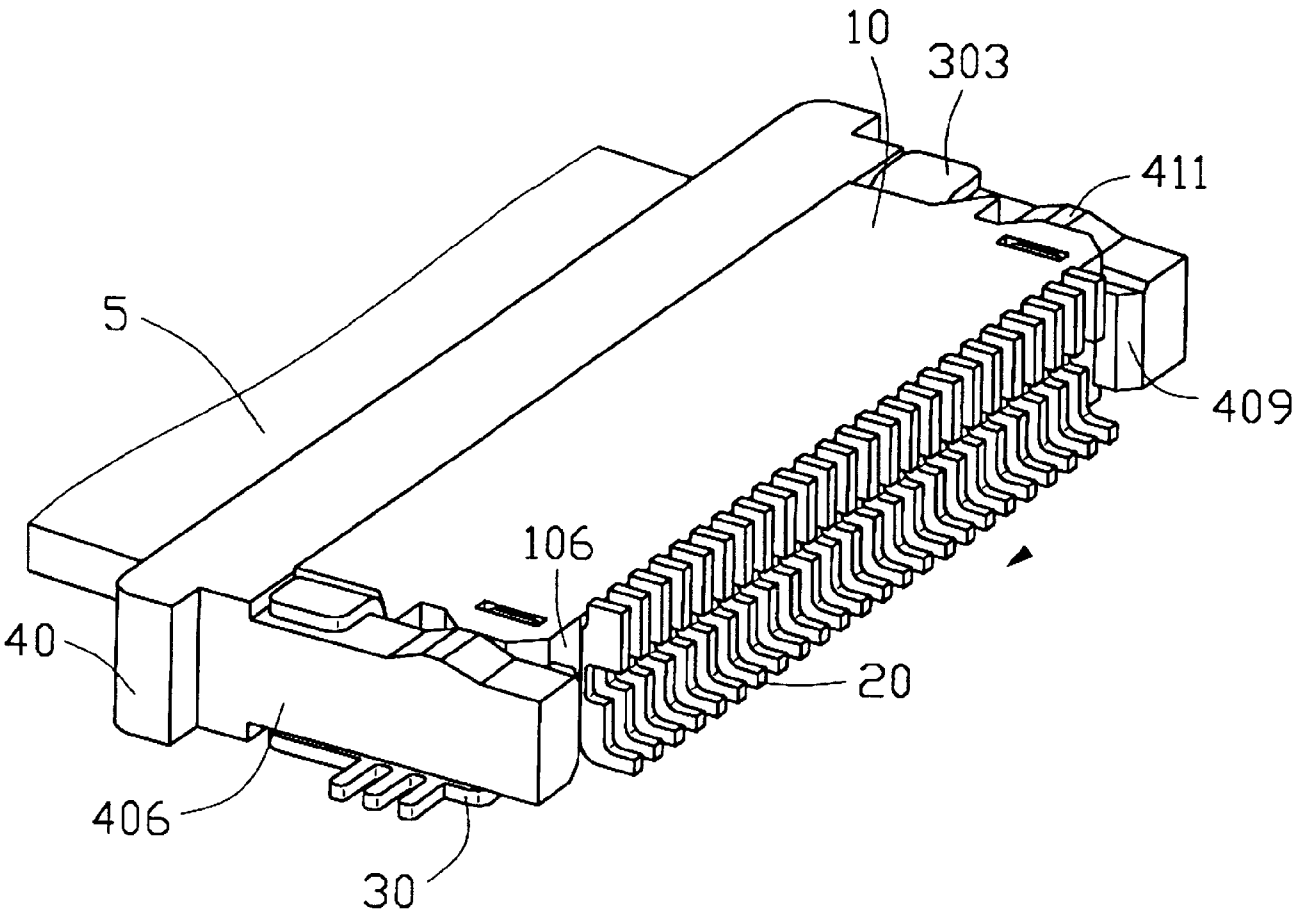
FIG. 4 is a view similar to FIG. 3, but showing the actuator of the FPC connector at a second position.

With reference to FIG. 4, when the FPC 5 is fully inserted into the FPC connector 1, the actuator 40 is pushed to a second position. An external force is exerted rearward against the manual portions 408 to push the locking arms 406 of the actuator 40 to slide across the bases 301. The lateral protrusions 409 slide across the second boss 110, and the engaging face 412 of each lateral protrusion 409 abuts against the rear wall 106 to securely fasten the actuator 40 onto the housing 10 and to prevent release of the FPC 5 from the housing 10. The hollow portion 405 of the actuator 40 is aligned with the cavity 105 of the housing 10. The front part 303 of the solder pad 30 retains the actuator 40 to the housing 10 by clamping at a front section of the locking arm 406. With the elongated tongue 402 completely received in the cavity 105 of the housing 10, the pressure plate 403 is partly received in the cavity 105 and biases the FPC 5 against the terminals 20.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

What is claimed is:

1. An electrical connector for a flexible printed circuit (FPC), comprising:

a housing comprising a pair of sidewalls, a boss formed on each sidewall, and a cavity defined between the sidewalls and exposed to a front thereof for receiving an end of the FPC;

a plurality of terminals received in the housing for electrically connecting with the FPC;

an actuator mounted on the housing and having a locking arm on each of two opposite sides thereof for engaging with the housing, the locking arm having an upper protrusion formed at a top face thereof for restraining the actuator relative to the housing at a first position and a lateral protrusion projecting from an inner side of an end section thereof for latching the boss of the housing at the first position; and a solder pad mounted on the housing, the solder pad having a front part having a top arm for restraining the upper protrusion at the first position to retain the actuator to the housing and a base adapted for being secured to a circuit board.

2. The electrical connector as claimed in claim 1, wherein the actuator comprises an elongated main body, a pair of manual portions formed on opposite sides of the main body, and a pair of openings respectively defined between the main body and the locking arms to receive the sidewalls of the housing.

3. The electrical connector as claimed in claim 2, wherein the main body has a pressure plate and a cover plate opposite to each other and defines an elongated hollow portion between the pressure plate and the cover plate and exposed to a front thereof.

4. The electrical connector as claimed in claim 3, wherein an elongated tongue extends rearwardly from the elongated pressure plate and is shaped with a decreasing thickness toward a rear thereof for facilitating insertion into the cavity of the housing.

5. The electrical connector as claimed in claim 1, wherein the housing comprises a pair of slots near the sidewalls, and wherein the solder pad has a rear arm for locking into a corresponding slot.

6. The electrical connector as claimed in claim 1, wherein the boss has a substantially planar narrow first edge, an inclined face and a planar face on opposite sides of the first edge, and wherein the second protrusion has an engaging face perpendicular to the locking arm for abutting against the planar face of the boss.

7. An electrical connector for a flexible printed circuit (FPC), comprising:

an insulative housing comprising a pair of side walls, each of said side walls defining first and second positions on an outer face thereof;

a cavity defined between said pair of side walls;

a plurality of terminals received within the housing;

an actuator mount to the housing, said actuator including an elongated tongue extending into the cavity, and a pair of locking arms by two sides of said tongue, each of said locking arms defining an inward protrusion at an end thereof; and a solder pad mounted to the housing, said solder pad including an outwardly facing U-shaped front part defining a channel for not only guidably receiving the corresponding locking arm therein but also providing intermediate restraint to the locking arm when said locking arm is locked at the first position with regard to the housing.

8. The connector as claimed in claim 7, wherein said locking arm includes an upper protrusion adapted to retainably engage the front part of the solder pad.

* * * * *